US005963761A

United States Patent [19]

Budnik et al.

[11] Patent Number: 5,963,761

[45] Date of Patent: Oct. 5, 1999

[54] AREA COVERAGE SENSOR CALIBRATION AND ALGORITHM FOR SEAM DETECTION NOISE ELIMINATOR ON A SEAMED PHOTORECEPTOR

[75] Inventors: Roger W. Budnik; Ralph A. Shoemaker, both of Rochester, N.Y.

[73] Assignee: Xerox Corporation, Stamford, Conn.

[21] Appl. No.: 09/274,068

[22] Filed: Mar. 22, 1999

Related U.S. Application Data

[60] Provisional application No. 60/081,807, Apr. 15, 1998.

[51] Int. Cl.[6] ..... G03G 15/00

[52] U.S. Cl. ..... 399/162

[58] Field of Search ..... 399/161, 162; 430/59, 126; 428/57; 226/35

[56] References Cited

U.S. PATENT DOCUMENTS 5,864,730 1/1999 Budnik et al. ..... 399/26

*Primary Examiner*—William Royer
*Assistant Examiner*—Greg Moldafsky
*Attorney, Agent, or Firm*—Kevin R. Kepner

[57] ABSTRACT

An apparatus and method for eliminating random noise and calibrating a seam detection sensor in an electrophotographic printing machine. When the detected centerline remains within the tolerance window the algorithm proceeds as normal. In most cases, however, the center line is shifted outside the tolerance window., either from 2 to −X or +X to N−1. When the centerline falls within either of these two ranges, the algorithm recognizes this fact and assumes that a random noise condition has occurred. It then proceeds to take the previous centerline (C) and add the current photoreceptor belt length to it. This, theoretically, should be exactly where the centerline should have been in the absence of noise. If this condition continues for three successive belt revolutions and the machine completes the job it was running, the algorithm will force the machine to search for the seam at the next cycle up. If the centerline is calculated to be at position 1 or N, the algorithm assumes some drastic change has occurred and an immediate fault is declared. To calibrate the sensor, the calibration algorithm increases the duration of each calibration pulse to 80 ms, and two reads per pulse are instituted. The algorithm then chooses the greater of the two reads on each individual step, thus eliminating any read of the seam which might adversely affect the calibration scheme.

1 Claim, 4 Drawing Sheets

AREA COVERAGE SENSOR CALIBRATION AND ALGORITHM FOR SEAM DETECTION NOISE ELIMINATOR ON A SEAMED PHOTORECEPTOR

This application is based on a Provisional patent application Ser. No. 60/081,807 filed Apr. 15, 1998.

This invention relates generally to an apparatus and method for locating a seam on a photoreceptor in an electrophotographic printing machine, and more particularly concerns an improved apparatus and method for calibrating and eliminating noise in such a locating sensor.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

With the implementation of seam detection in xerographic machines, it is imperative that the process be immune to random noise in order to function properly. The term "random noise" encompasses any electrical noise that may be picked up by the black toner area coverage (BTAC) sensor or any toner or dirt that may have fallen on the seam as it passes under the BTAC. This invention proposes to recognize these noise conditions, and make dynamic adjustments to the detection process.

Loss of the seam during a copy run will cause the machine to shutdown with an appropriate fault message. Seam loss results in misregistration of the image onto the copier paper. If this shutdown could be prevented and image registration could still be maintained, customer satisfaction would remain unaffected.

In accordance with one aspect of the present invention, there is provided a method for eliminating noise in detecting a seam in a photoreceptor in a printing machine, comprising detecting an apparent seam location in the photoreceptor, comparing the apparent location with a predetermined tolerance window, determining if the apparent location falls outside of the predetermined tolerance window for a predetermined plurality of detections and declaring a fault if the apparent location falls outside of the predetermined tolerance window a greater number of times than the predetermined plurality.

Pursuant to another aspect of the present invention, there is provided a method of calibrating a seam detecting sensor, comprising emitting a sampling pulse of at least 2N, where N is the anticipated width of a seam, making two reading during each sampling pulse, comparing the value of each read during each pulse and utilizing the higher read value when the two read values are not equal to eliminate any interference of the seam on the calibration process.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
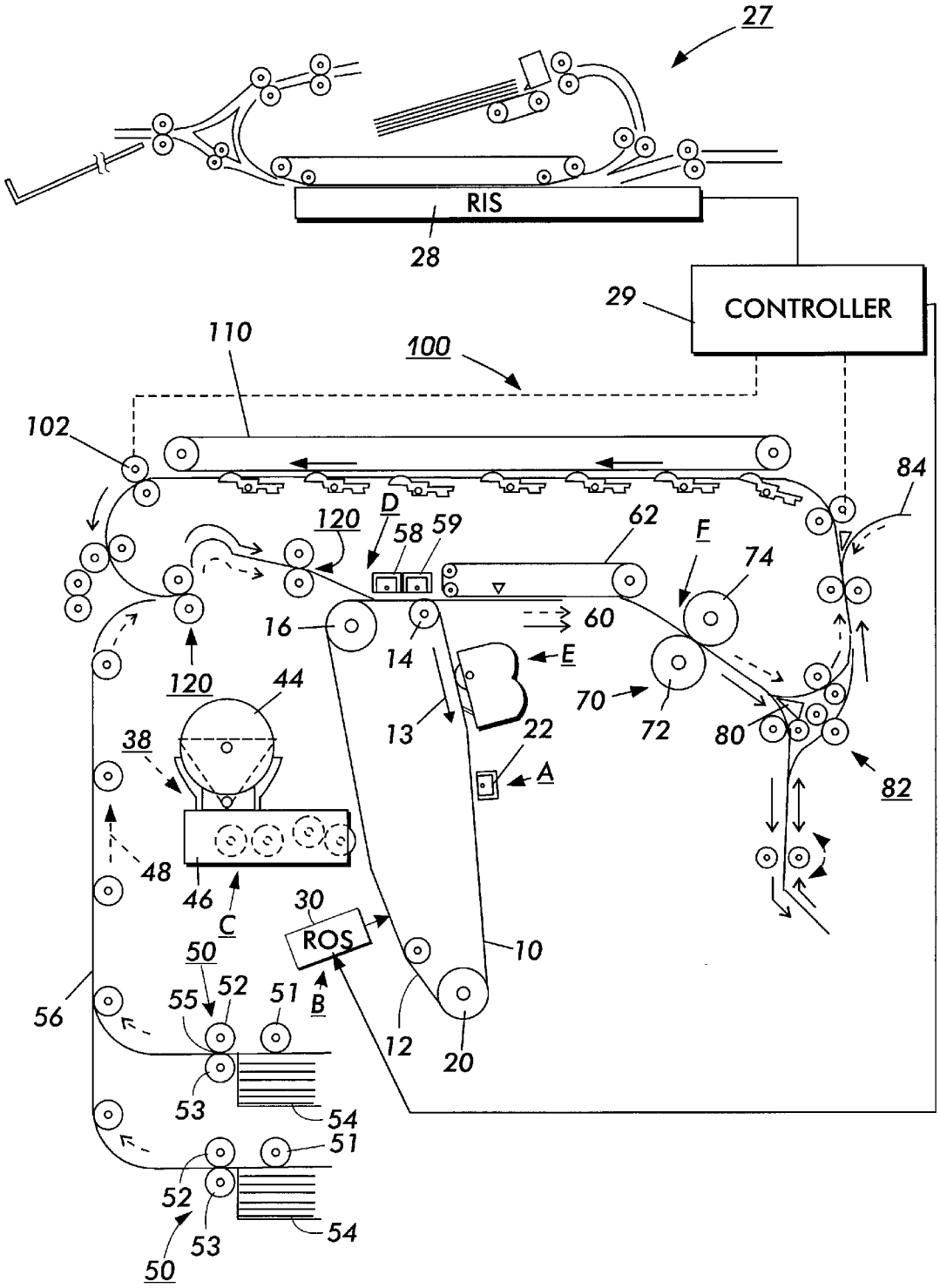
FIG. 1 is a schematic elevational view of a typical electrophotographic printing machine utilizing the sheet deskew and registration device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the stalled roll registration device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 using the array sensor of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
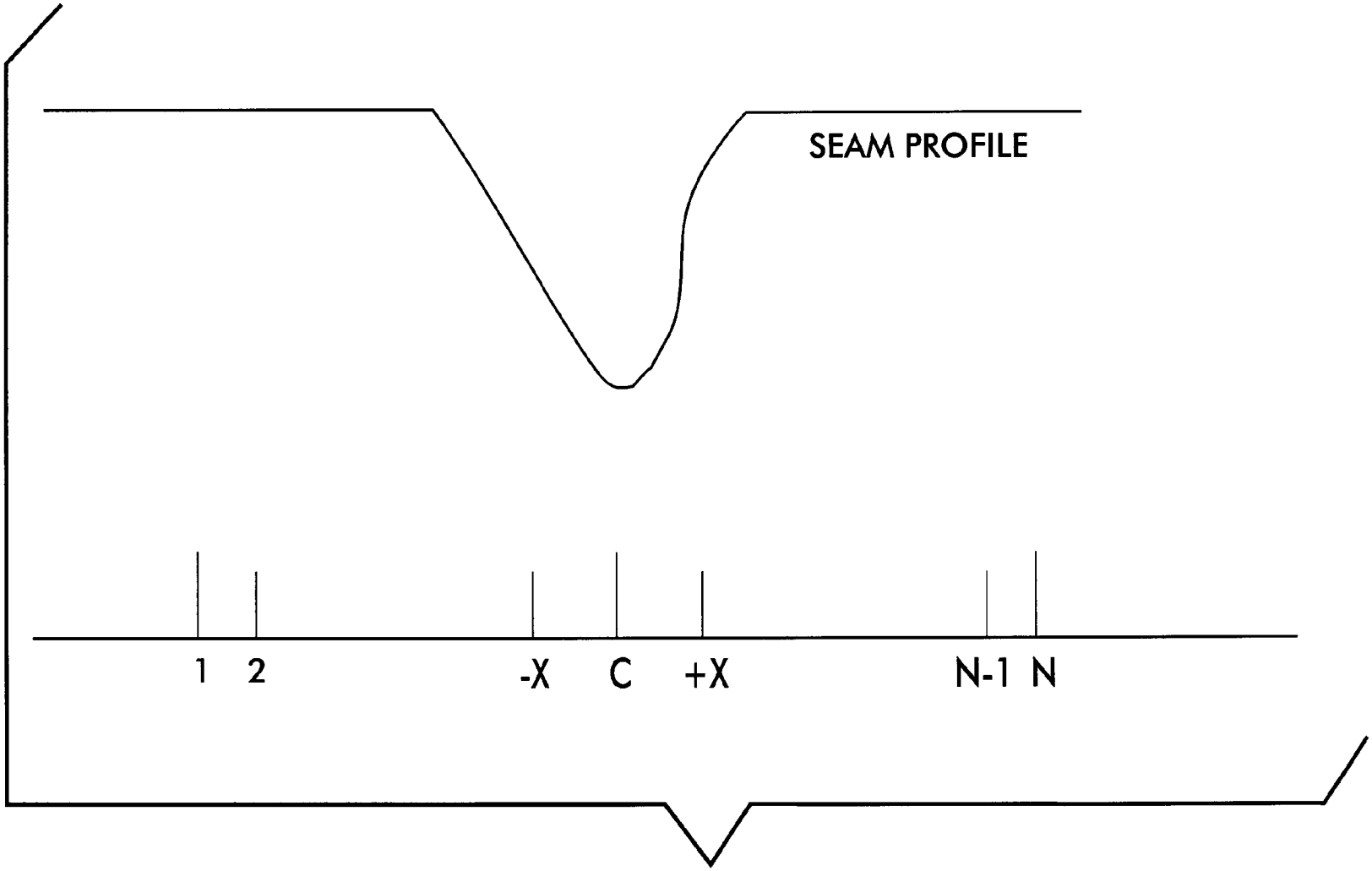
FIG. 2 is a graph illustrating a seam profile reading from a BTAC sensor.

The noise elimination scheme operates in the following manner: The BTAC sensor (reference numeral 150 in FIG. 1) takes a specific number of samples (N) as the general location of the seam passes under it. It then computes the area under the seam curve and finds its center of moment which in fact is the centerline of the seam (X). Let −X to +X be the nominal tolerance that the seam centerline can vary over the sample range. Within this tolerance window, the algorithm remains unaffected and the centerline value is stored as "C" Refer to FIG. 2.

When noise is present or toner falls onto the seam, the area of the seam will grow. In some cases, the centerline remains within the tolerance window and the algorithm proceeds as normal. In most cases, however, the center line is shifted outside the tolerance window., either from 2 to −X or +X to N−1. When the centerline falls within either of these two ranges, the algorithm recognizes this fact and assumes that a random noise condition has occurred. It then proceeds to take the previous centerline (C) and add the current photoreceptor belt length to it. This, theoretically, should be exactly where the centerline should have been in the absence of noise. If this condition continues for three successive belt revolutions and the machine completes the job it was running, the algorithm will force the machine to search for the seam at the next cycle up. If the centerline is calculated to be at position 1 or N, the algorithm assumes some drastic change has occurred and an immediate fault is declared.

While using the above method of photoreceptor registration via seam detection, it is imperative that the BTAC sensor be calibrated before seam detection is attempted. A paradox exists in that the seam which is trying to be detected may interfere with the process and cause an inaccurate calibration. This invention also provides a technique which allows for an accurate calibration of the BTAC anywhere on the photoreceptor surface.

Xerographic print engines which contain a belt hole sensing system have an advantage in that the seam location can be detected before a calibration sequence is performed on the BTAC sensor. On an engine where the seam is detected by the BTAC, the sensor must be calibrated before the seam can be found. Otherwise, inaccurate results may occur. This invention modifies the existing technique for calibrating the BTAC sensor, this making it more robust to handle the varied applications asked of it.

Figure 3:
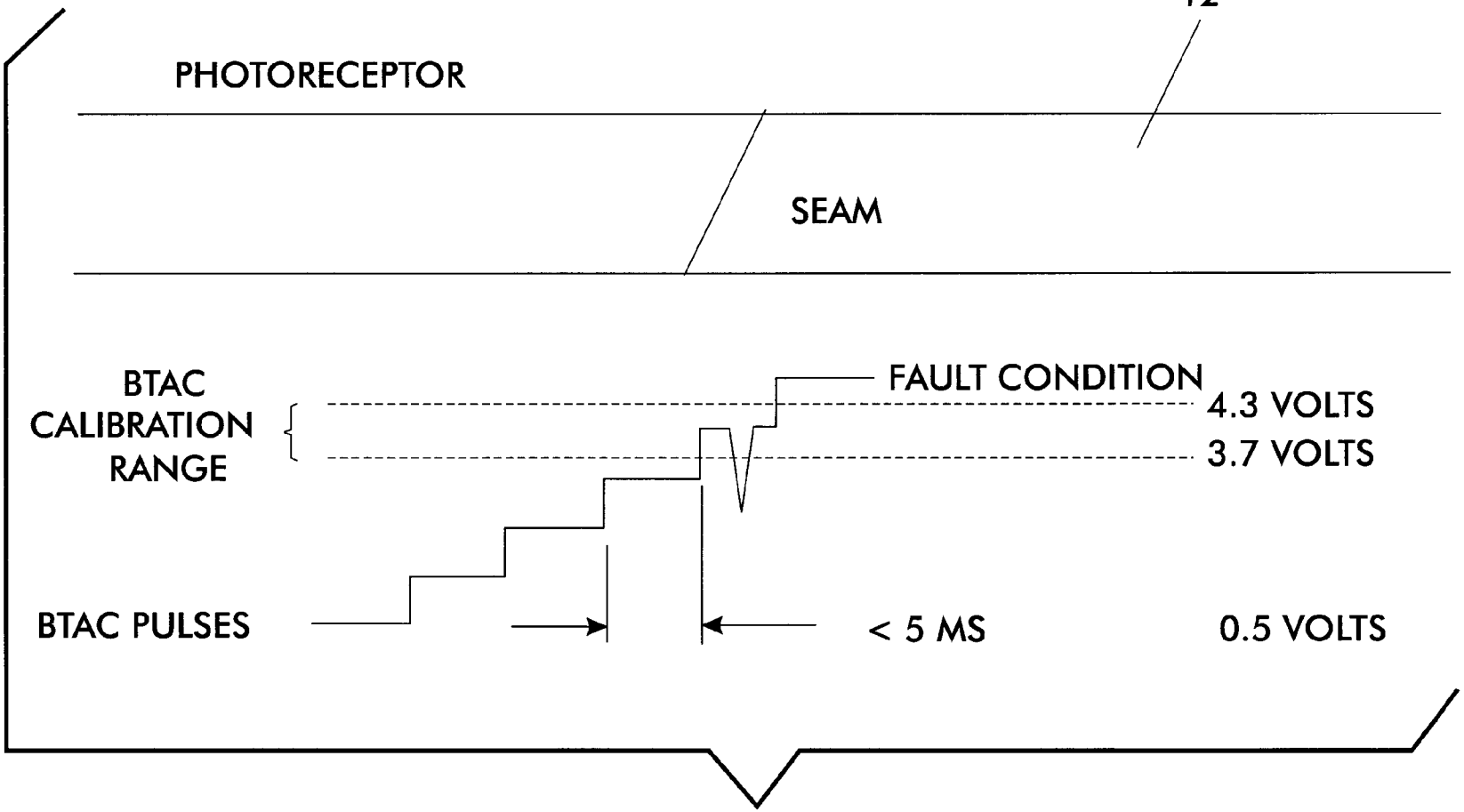
FIG. 3 is a graph illustrating a known seam detecting method.

During the calibrate sequence, the sensor's light source is pulsed until an output signal is reached between 3.7 volts and 4.3 volts. This voltage is the reflective light sensed by the BTAC and fed back through an A/D converter of the system electronics. The duration of each pulsation is between 1–5 ms (one read per pulse). However, as illustrated in FIG. 3, if the seam is read during one of these pulses, an added step in the sequence is taken (the seam is less reflective than the bare photoreceptor) and an inaccurate calibration will occur. In some instances, a fault may occur because the BTAC may "overshoot" the upper 4.3 volt limit, resulting in an undesirable condition.

Figure 4:
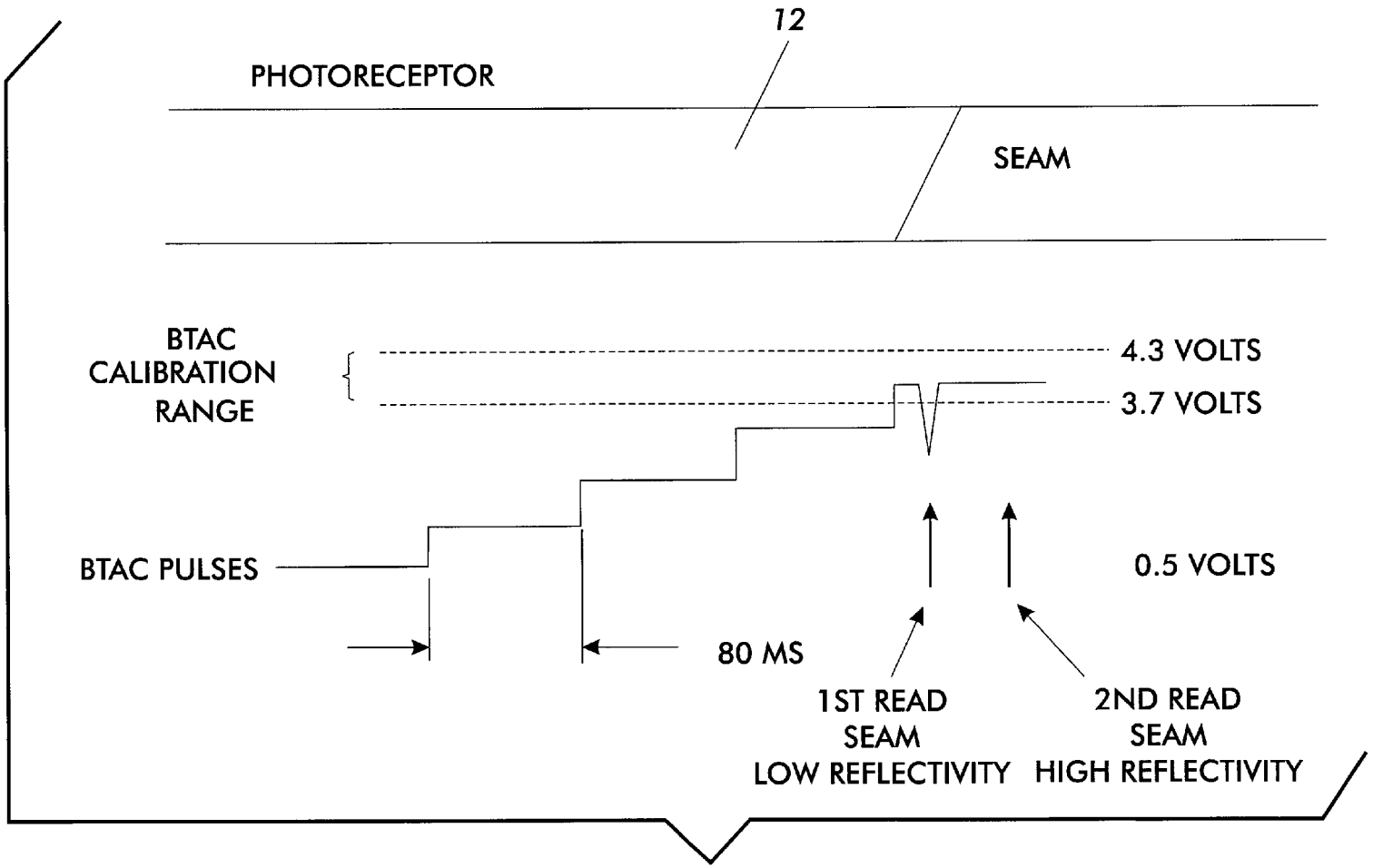
FIG. 4 illustrates the method of seam detection according to the invention.

If the seam width (as seen by the BTAC) varies between 15 ms to 30 ms, a new sampling technique as illustrated in FIG. 4 was devised which negated any interference by the seam. The calibration algorithm increases the duration of each pulse to 80 ms, and two reads per pulse are instituted. The algorithm then chooses the greater of the two reads on each individual step, thus eliminating any read of the seam.

Although simplistic in nature, this allows for accurate calibration of the BTAC when the seam location is unknown. This invention has been implemented successfully and has become an integral part of the seam detection and process control strategy.

While the invention herein has been described in the context of a black and white printing machine, it will be readily apparent that the device can be utilized in any printing machine to eliminate random noise and calibrate a sensor to detect a seam in a photoreceptor.

In recapitulation, there is provided an apparatus and method for eliminating random noise and calibrating a seam detection sensor in an electrophotographic printing machine. When the detected centerline remains within the tolerance window the algorithm proceeds as normal. In most cases, however, the center line is shifted outside the tolerance window., either from 2 to −X or +X to N−1. When the centerline falls within either of these two ranges, the algorithm recognizes this fact and assumes that a random noise condition has occurred. It then proceeds to take the previous centerline (C) and add the current photoreceptor belt length to it. This, theoretically, should be exactly where the centerline should have been in the absence of noise. If this condition continues for three successive belt revolutions and the machine completes the job it was running, the algorithm will force the machine to search for the seam at the next cycle up. If the centerline is calculated to be at position 1 or N, the algorithm assumes some drastic change has occurred and an immediate fault is declared. To calibrate the sensor, the calibration algorithm increases the duration of each calibration pulse to 80 ms, and two reads per pulse are instituted. The algorithm then chooses the greater of the two reads on each individual step, thus eliminating any read of the seam which might adversely affect the calibration scheme.

It is, therefore, apparent that there has been provided in accordance with the present invention, a noise elimination and sensor calibration apparatus and method that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for eliminating noise in detecting a seam in a photoreceptor in a printing machine, comprising;

detecting an apparent seam location in the photoreceptor;

comparing the apparent seam location with a predetermined tolerance window;

determining if the apparent seam location falls outside of the predetermined tolerance window for a predetermined plurality of detections;

declaring a fault if the apparent seam location falls outside of the predetermined tolerance window a greater number of times than the predetermined plurality.

* * * * *